US009220940B2

(12) United States Patent
AL Kuwari

(10) Patent No.: US 9,220,940 B2
(45) Date of Patent: Dec. 29, 2015

(54) SAND TREADMILL WALKING DEVICE

(71) Applicant: Hamad Saad AL Kuwari, Doha (QA)

(72) Inventor: Hamad Saad AL Kuwari, Doha (QA)

( * ) Notice: Subject to any disclaimer, the term of this patent is extended or adjusted under 35 U.S.C. 154(b) by 191 days.

(21) Appl. No.: 13/736,991

(22) Filed: Jan. 9, 2013

(65) Prior Publication Data

US 2013/0178340 A1 Jul. 11, 2013

Related U.S. Application Data

(60) Provisional application No. 61/584,533, filed on Jan. 9, 2012.

(51) Int. Cl.
*A63B 22/02* (2006.01)

(52) U.S. Cl.
CPC ..... *A63B 22/0235* (2013.01); *A63B 22/0207* (2015.10); *A63B 22/0285* (2013.01); *A63B 2220/78* (2013.01)

(58) Field of Classification Search
CPC ..... A63B 22/0235; A63B 22/0285; A63B 22/0207; A63B 2220/78
USPC ..... 482/54, 51, 55; 198/388
See application file for complete search history.

(56) References Cited

U.S. PATENT DOCUMENTS

| | | | | |
|---|---|---|---|---|
| 4,146,222 | A | 3/1979 | Hribar | |
| 4,674,622 | A | 6/1987 | Utsunomiya et al. | |
| 5,993,358 | A | 11/1999 | Gureghian et al. | |
| 7,704,191 | B2 | 4/2010 | Smith et al. | |
| 8,012,068 | B1 | 9/2011 | Malcolm | |
| 8,734,301 | B2 * | 5/2014 | Remelius | 482/54 |
| 2004/0171465 | A1 * | 9/2004 | Hald et al. | 482/54 |
| 2013/0281241 | A1 * | 10/2013 | Watterson et al. | 474/268 |

* cited by examiner

*Primary Examiner* — Loan H Thanh
*Assistant Examiner* — Megan Anderson
(74) *Attorney, Agent, or Firm* — Daniel Boudwin; Global Intellectual Property Agency LLC

(57) ABSTRACT

Disclosed is a treadmill device providing a cushioned layer of sand to walk upon. The device comprises a base having a conveyor walking surface and an underside sand storage area. The base connects to an upstanding support having a control interface to establish the walking surface speed. A second sand conveyance means draws collected sand from the lower storage area and dispenses a continuous and uniform volume of sand onto the leading end of the conveyor walking surface. The sand is then leveled to a defined depth and conveyed toward the trailing end of the walking surface. Sand is collected along the sides of the walking surface and along the trailing end thereof, whereby the sand is recollected and conveyed again to the walking surface leading end for reuse. The sand is then treated by high intensity light to prevent bacteria from forming in the sand over long periods of non-use.

13 Claims, 3 Drawing Sheets

SAND TREADMILL WALKING DEVICE

CROSS REFERENCE TO RELATED APPLICATION

This application claims the benefit of U.S. Provisional Application No. 61/584,533 filed on Jan. 9, 2012, entitled "Sand Beach Treadmill." The above identified patent application is herein incorporated by reference in its entirety to provide continuity of disclosure.

BACKGROUND OF THE INVENTION

1. Field of the Invention

The present invention relates to exercise devices and walking machines. More specifically, the present invention pertains to a new and unique treadmill device that allows a user to walk along a conveyor belt supporting a layer of sand to simulate walking on a beach or across sandy terrain.

Treadmills are commonly known exercise devices that allow a user to walk or run without actually moving across an open space. The device allows a user to engage in the exercise while remaining in one location, whereby a conveyor running surface moves beneath the user to simulate the moving ground beneath the runner. These devices are useful for general exercise, for medical diagnostics when monitoring a user's response to an activity, and for training or rehabilitation purposes. Most of these devices employ a structure that includes a base having a motorized conveyor upon which a user walks or runs upon, an upstanding support for the user to grasp when necessary and to control the speed or inclination of the conveyor, and an electric motor that drives the conveyor belt running surface.

While exercise treadmills are well described in the art, a common complaint is that these devices lack cushioning or shock absorption. The treadmill conveyor surface generally requires footwear be utilized in order to maintain traction on the conveyor surface and to minimize impact loading on the user's feet. Devices have been disclosed in the art for improving the energy attenuation qualities of the running surface to compensate for the repeated impacts of a user, including various cushioning means or shock absorbing systems. However, many runners enjoy engaging in barefoot running, or natural running, whereby the runner runs without the use of restrictive footwear. It is argued that this allows the muscles in the foot and ankle to be developed and strengthened, and further for the foot to be removed of any unnatural restriction. This presents a problem when running on most common conveyor belt treadmills, as the surface tends to be slick and not forgiving to the user's bare feet.

The present invention describes a walking treadmill device that includes a layer of sand over a treadmill conveyor surface, whereby the user is capable of walking across a comfortable and cushioned layer of granular material that is conducive to barefoot exercising and for taking relaxing walks when desired. The device comprises a treadmill apparatus that is similar in structure to an exercise treadmill, whereby the apparatus further comprises a storage area for sand material and a second conveyor system for transporting the sand from the storage area and placing it onto the leading end of the conveyor walking surface. A uniform layer of sand is continuously provided for the user, whereafter the sand is recollected into the storage area to be ushered forward to be recycled onto the walking surface. It is desired to disclose a walking device that allows for comfortable exercise, leisurely strolls along a sand surface, rehabilitation using a cushioned walking surface, or for training in a sand environment.

2. Description of the Prior Art

Devices have been disclosed in the prior art that relate to cushioned treadmill devices and exercise equipment. These include devices that have been patented and published in patent application publications, and generally relate to shock absorbing treadmills that reduce impact loads on the user's feet while running or walking on the treadmill conveyor belt. No devices contemplate a sand surface upon which a treadmill user to walk or run. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 8,012,068 to Malcolm discloses a cushioned treadmill that includes a base having a belt assembly that forms a running assembly. Below the running assembly is a flexible bladder comprising of a cushioning material that absorbs impacts from the user's feet on the running surface and cushions the user's feet. The bladder is in direct connection with the running surface to absorb impacts and prevent the user's feet from experiencing high impact loads while running or walking. The Malcolm device, while providing a treadmill with a cushioned surface, does not describe a treadmill device that provides a user with the experience of running or walking directly on a layer of sand, as is provided by the present invention. The cushioning is provided below the conveyor belt running surface in the Malcolm device, attenuating energy but not providing the same tactile sensation and direct cushioning of running on a layer of sand.

U.S. Pat. No. 5,993,358 to Gureghian discloses a controllable platform for a treadmill device whereby the impact condition of the user contacting the treadmill deck is controlled by a user-selectable damping and stiffness to simulate different surfaces. A suspension system controls a flexible and tilting deck that moves relative to the treadmill frame. The user contacting the treadmill deck causes the deck to bound with a given displacement characteristic defined by the selected damping and stiffness controls, whereafter the deck can rebound when the user steps from the deck. The Gureghian device discloses a new and novel rebounding and attenuating treadmill deck for varying the characteristics of the running surface; however, the Gureghian device fails to disclose a treadmill device that is specifically designed as a means to provide a user with the ability to walk across sand. The present invention is a treadmill that provides a continuous surface of sand that is conveyed from the forward to rear portion of the treadmill and having a defined thickness thereof. This allows the user to walk barefoot or with footwear and train for running on sand or alleviate the stress otherwise involved with running on harder surface.

Another such device is U.S. Pat. No. 7,704,191 to Smith, which discloses a treadmill exercise device having a first and second pivotable treadle surface, whereby each of the user's feet can make contact with an separate treadmill surface. The treadles are pivotable about an axis and are interconnected with one another to provide an alternating upward and downward movement relative to one another while in operation. The pivoting action changes the angle of each walking surface for each of the user's feet. The structure of the Smith device includes an inner support that allows each treadle to be positioned closely to one another to eliminate the need for the user straddle an otherwise large gap when exercising. The use of the inner support structure and a single rear roller eliminates the need for two separate rollers and their associated bears, which would separate the treadles. While disclosing a novel construction for a dual treadle exercise machine, the Smith device fails to contemplate a sand treadmill surface, as is lacking in the prior references.

Finally, U.S. Pat. No. 4,146,222 to Hribar discloses a fluid filled jogging exercise device that comprises a treadmill conveyor having an internally-mounted fluid volume enclosure to variably absorb impact loads from the exercising user. The volumes are capable of deforming, whereby fluid is displaced from one volume to an adjacent volume through a fluid port. The port is adjustable to control the flow rate between fluid volumes, thereby adjusting the stiffness and damping qualities of the assembly. The assembly reduces impact loads on the user's feet and joints and is adjustable. A restraining member may also be incorporated into the volumes to prevent pillowing of the upper and lower surfaces thereof as the fluid is evacuated from the given volume by the compressive load imparted on the system by a user's feet. Similar to the aforementioned devices, the Hribar device discloses a stiffness and damping adjustable treadmill device, but fails to disclose the novel sand contact interface provided by the present invention. The present invention is designed to provide a sand running surface, reducing stress on the user's joints but also simulating running in a sandy environment for training or exercising purposes.

The present invention discloses a sand surface walking treadmill that communicates sand from a storage area and onto a treadmill walking surface, whereby a uniform and continuous layer of sand is provided for the user to walk upon. The sand is recollected and recycled to prevent any gaps in the walking surface, while further the sand in the collection area is sterilized within the storage area between uses. It is submitted that the present invention is substantially divergent in design elements from the prior art, and consequently it is clear that there is a need in the art for an improvement to existing treadmill devices. In this regard the instant invention substantially fulfills these needs.

SUMMARY OF THE INVENTION

In view of the foregoing disadvantages inherent in the known types of treadmill devices now present in the prior art, the present invention provides a new sand surface walking treadmill that can be utilized for providing convenience for the user when engaging in physical activity, rehabbing an injury, training, or leisurely walking across a layer of sand for pleasure purposes.

It is therefore an object of the present invention to provide a new and improved treadmill walking device that has all of the advantages of the prior art and none of the disadvantages.

It is another object of the present invention to provide a sand surface treadmill device that provides a continuous layer of sand for which a user to walk upon in one space, whereby the sand is provided with a uniform thickness and at a defined speed as desired by the user.

Another object of the present invention is to provide a sand surface treadmill device that resembles a standard treadmill with an enlarged sand storage area thereunder for which to house the necessary quantity of sand and the conveyor assembly for drawing the sand therefrom and onto the walking surface conveyor.

Yet another object of the present invention is to provide a sand surface treadmill device that includes an ultraviolet light or heating lamp sanitizing treatment within the sand storage area to reduce contaminates and bacteria growth between treadmill uses.

Another object of the present invention is to provide a sand surface treadmill device that circulates the same quantity of sand within the device and limits any sand exiting the device during use.

Another object of the present invention is to provide a sand surface treadmill device that offers a user a cushioned sand surface upon which to walk upon that is both comforting, therapeutic, and a training tool.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
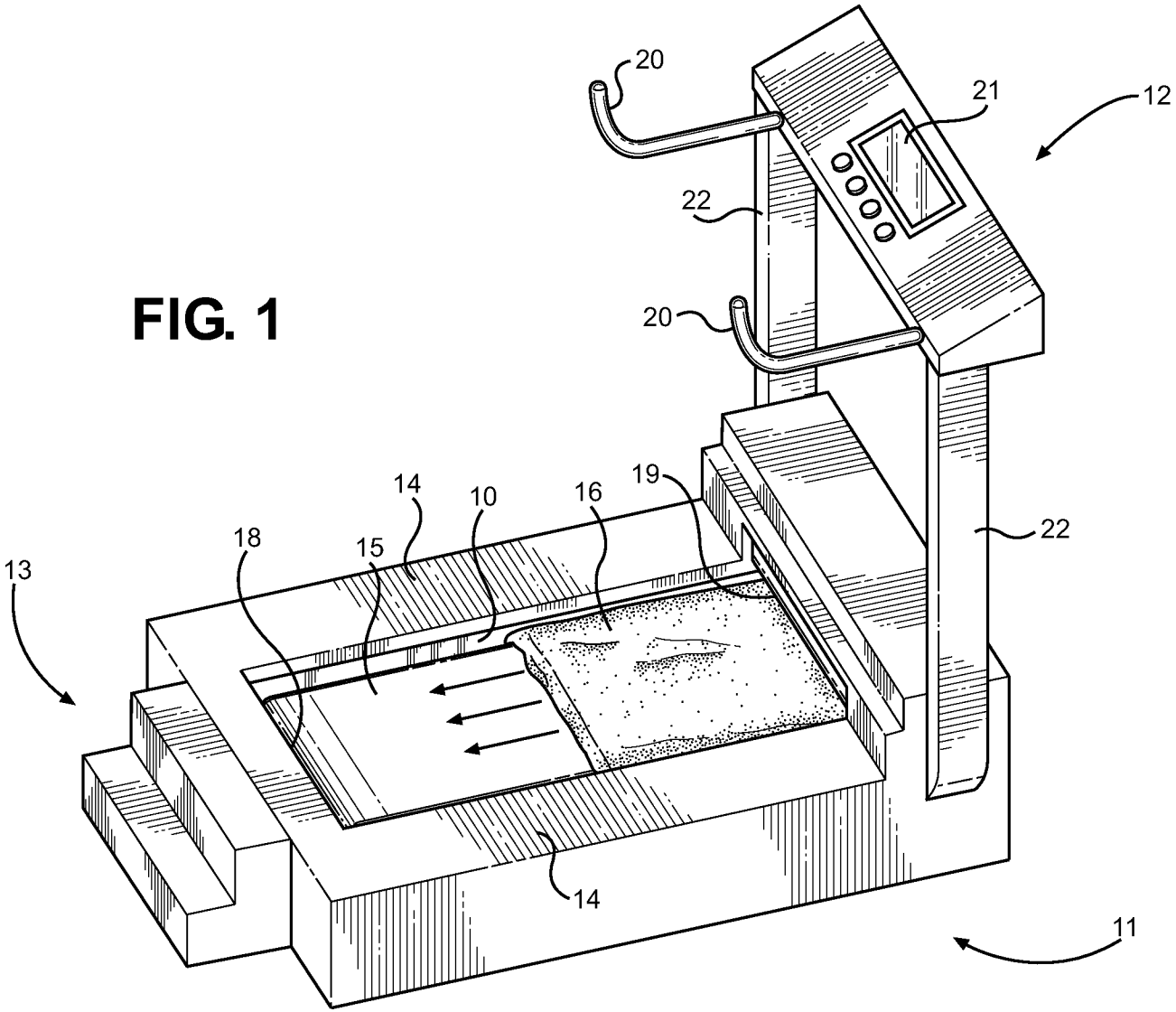
FIG. 1 shows a perspective view of the present invention in a working state.

Reference is made herein to the attached drawings. Like reference numerals are used throughout the drawings to depict like or similar elements of the sand surface treadmill device. For the purposes of presenting a brief and clear description of the present invention, the preferred embodiment will be discussed as used for providing a continuous layer of sand to walk upon for relaxation, training, or rehabilitation purposes. The figures are intended for representative purposes only and should not be considered to be limiting in any respect.

Referring now to FIG. 1, there is shown a perspective view of the present invention in a working state. The present invention comprises a treadmill device that conveys a layer of sand 16 at a given speed along a pathway to provide a stationary walking path for a user. The device comprises a base 11 having an internal sand storage area, a sand conveyance means that draws sand from the storage area, and a walking path sand conveyor 15. Sand 16 is drawn from the storage area within the base 11 and placed uniformly on the leading end of the walking path conveyor 15, whereafter a bridge 19 levels the sand to a uniform thickness prior to the sand 16 being exposed along the pathway between a pair of opposing side portions 14 for the user to walk upon. The side portions 14 are raised areas on lateral sides of the walking path that include a horizontal ledge and an open conduit 10 along the sides of the pathway 15 that leads directly to the sand storage area therebelow. The open conduit 10 is a secondary sand collection means that allows sand to fall from the walking path conveyor 15 along its sides to be collected in the sand collection area and thereafter be ushered toward path leading end of the conveyor 15 for reuse. This prevents sand 16 from leaving from the sides of the treadmill device and prevents loss of sand over time. The primary sand collection means, however, is located at the trailing end 18 of the walking path, whereby sand 16 traveling at the speed of the conveyor 15 is deposited into the sand storage area directly as the conveyor ceases moving rearward and follows the path of a rear pulley or bushing, casing the conveyor belt to wrap underneath the walking path towards the leading end of the pathway.

The base 11 houses the sand storage area, its conveyance means, and the walking path; therefore the walking path may be elevated above the ground surface. A plurality of steps 13 may be provided at the trailing end of the pathway to allow a user to easily access the treadmill pathway when initiating the exercise. Along the forward portion of the base 11 is an upstanding handrail 12 that provides user support during the exercise and a means to control the speed of the conveyor walking path 15. The handrail 12 comprises a pair of upstanding support members 22 that connect to an interface 21 that provide control of the device electric motors driving the conveyors. Thus the walking speed of the user is adjustable, as is commonly provided in most treadmill devices. Extending from the handrail 12 may further be a first and second hand grip 20 for the user to grasp while walking to maintain balance during exercise.

Figure 2:
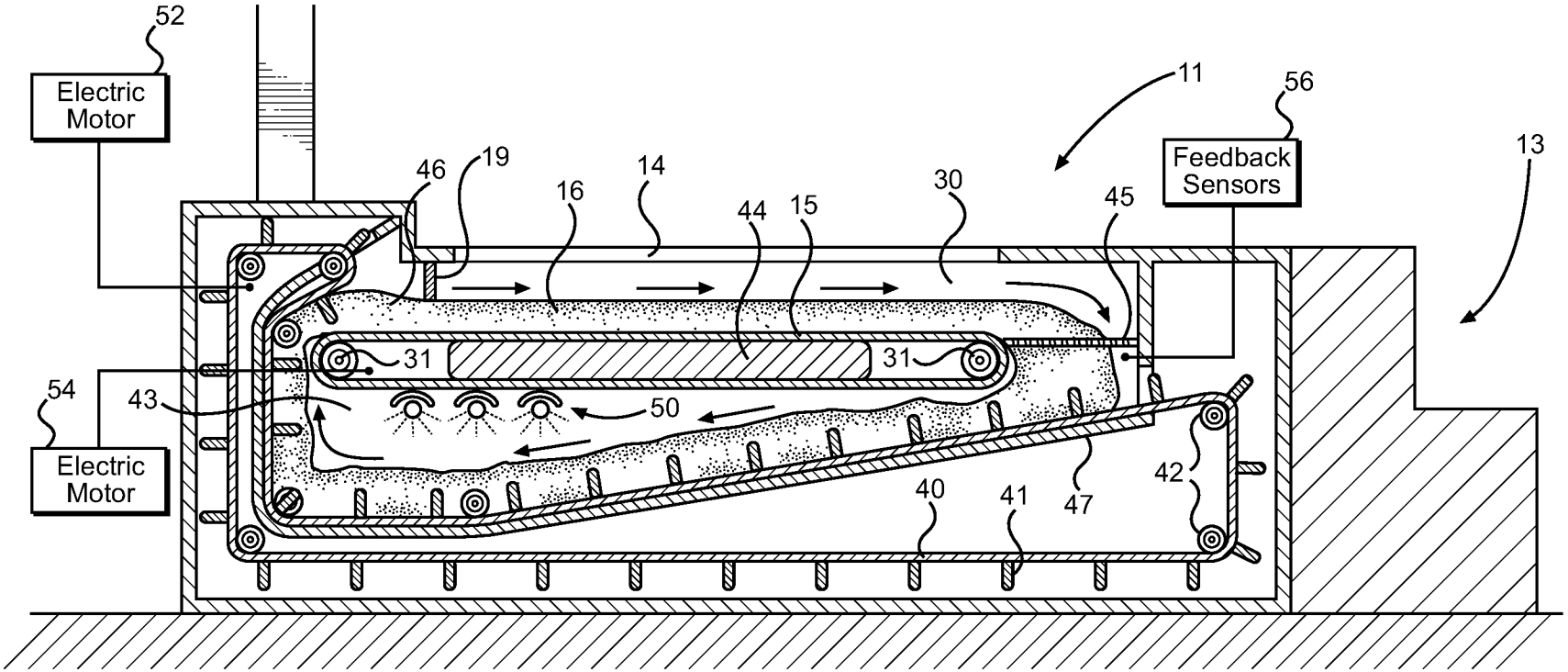
FIG. 2 shows a cross section view of the present invention, including the walking conveyor, the sand storage area, and the sand conveyance means.

Referring now to FIG. 2, there is shown a cross section view of the base 11 of the treadmill device. This view illustrates an embodiment of the sand conveyance means that communicates sand 16 from the sand storage area 43 to the sand walking path conveyor 15. It is desired to disclose a working embodiment of the system that is capable of transferring a continuous and uniform volume of sand from the storage area to the walking path conveyor 15 such that the walking surface is consistent at all walking path conveyor 15 speeds of operation. As visualized, a first sand conveyance means within the base comprises an elongated conveyor belt 40 having a plurality of paddles 41 is provided, whereby sand is communicated from the trailing end 30 of the device to the leading end, elevated, and then deposited onto the leading end 46 walking surface conveyor 15.

The conveyor belt 40 is driven by an electric motor 52, which drives the belt around a series of pulleys 42 that tension the belt 40 and create a path for the paddles 41 that draws sand 16 forward, then upward, and then deposits the sand onto the leading edge of the walking path conveyor 15. A leveling bridge 19 then creates a level top surface and uniform thickness layer of sand for the user to walk upon. Sand 16 travels along the walking path conveyor 15 and is deposited along the trailing end of the device 30 and along conduits under the side portions 14. A finger and discrete object screen 45 is placed along the trailing end and along the sides of the walking path 15 such that a user's limbs or other articles are prevented from being drawn into the base 11 of the device.

Similar to the sand conveyor belt 40, the walking path conveyor belt 15 is driven by an electric motor 54 and tensioned between pulleys 31 or bushings at the leading 46 and trailing ends 30 of the pathway. A support member 44 between the upper and lower conveyor belt 15 surfaces may be provided to support the weight of a user standing on the pathway such that the conveyor belt 15 does not stretch, collapse, or fail during operation. The speed with which the walking path conveyor belt 15 travels is controlled by the user, and programmed logic of the overall treadmill control system may determine the appropriate sand conveyor belt 40 speed to satisfy the sand volume needs of the walking path belt 15. This control system may be aided by feedback sensors 56 that update the device as to the actual quantity of sand being dispensed versus what is required, as there is some variation depending on the amount of sand leaving the walking path along the sides and trailing end based on user interaction therewith.

The sand storage area 43 is preferably a sealed chamber comprising enclosure sidewalls 47 and penetrations therethrough only for the conveyance belt 40, its associated paddles 41, and the areas of sand infiltration from the walking path. This creates a closed loop system that minimizes loss of sand from the storage area within the base 11, and further prevents sand from entering areas receiving electrical power, such as the electric motors driving the conveyor belts or the associated electrical connections therefor. Within the base is also a plurality of high intensity ultraviolet (UV) and/or heat lamps 50. These lamps 50 are utilized to sanitize the sand as it is used and between uses, such that the sand remains as fresh as possible over a prolonged period. Preventing sand loss and preventing contamination of the sand are both crucial to extending the useful life of the sand within the device. This reduces the frequency with which the user is required to refresh or replace the sand, minimizing hardships placed on the device owner and associated maintenance costs.

Each belt 15, 40 may be independently driven its own electric motor, or alternatively both belts may be driven by the same motor, as required by the relative speeds of the two belts and the requirements of the system. At different walking speeds, the ratio of the two belts may not be uniform or linear, requiring one belt to be driven faster or slower relative to a second belt to meet the sand demands of the walking path. It is contemplated that the exact design of the system may incorporate at least one electric motor and at least two conveyor systems: one belt establishing the walking path and a second belt for conveying sand from the storage area to the walking path belt. It is also contemplated that more than two belts may be required and more than one electric motor, depending on the viscosity of the sand, the speed of the walking path, the volume demands of the system and the efficiency with which the system can recover and replenish the sand throughout the system.

Prior to use, the user uses the steps 13 to gain access to the walking path 15, whereafter the controls mounted on the handrail are manipulated to initiate the exercise and start the streaming of sand along the walking path. The system can be designed evacuate sand from the walking path after use by continuing to run the walking path belt 15 for a period of time without using the sand conveyor belt within the sand storage area. This clears the walking path of any sand between uses. The storage area is oversized to accommodate all of the sand in the system for storage therein over extended periods. Alternatively, a layer of sand may be kept on the walking path between uses, which reduces the complexity of the system with regards to running the belts independently to clear the pathway, but also exposes a quantity of sand to the environment for extended periods.

Figure 3:
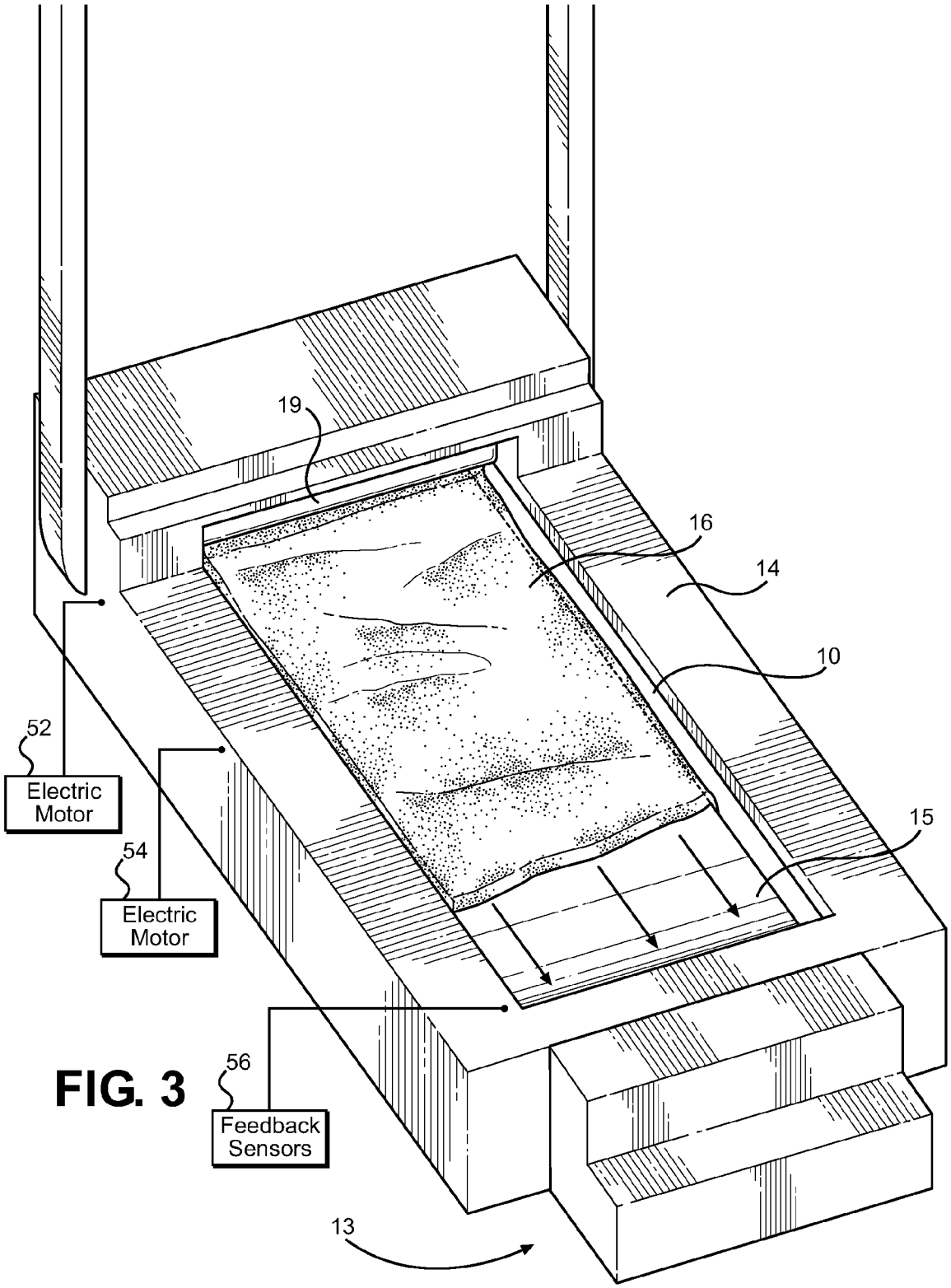
FIG. 3 shows an overhead perspective view of the present invention in a working state.

Referring now to FIG. 3, there is shown an overhead perspective view of the present invention in a working state. In this view, the walking path conveyor is visualized 15 moving a layer of sand from the device leading end toward the trailing end, whereby sand is deposited into the base for recycling forward. The side portion conduit 10 between the pathway 15 under the side portions 14 is further visualized, where sand 16 is able to expand outward and back into the base rather than being prone to overflowing the sides and spilling onto the floor.

During use, the user steps 13 up to the level of the walking path and initiates the walking path conveyor. A uniform thickness of sand is then conveyed along this pathway for the user to walk upon. The forward leveling bridge 19 ensures the sand is of uniform height such that the user does not trip from unexpected peaks in the sand, while the sand storage area conveyor ensures an adequate volume of sand is transferred from the storage area and onto the walking path given the chosen walking speed. The bridge 19 can be adjusted to the user's desired sand thickness. The sand 16 is uniformly distributed to create a sufficient depth of sand on the walking path belt surface to absorb the user's foot impact caused when walking. This provides users with the feeling of walking on the beach or in similar sandy environments. Users with leg problems, such as shin splints or bursitis will be able to use the device for exercise, rehabilitation, while all users will be able to utilize the sand-covered walking surface for enjoyment.

Between uses, the sand within the storage area is sanitized and dried between using an ultraviolet lighting or heating lamp system. The sand is sterilized by the light and moisture is removed from the area by the heat therefrom before being reused to prevent unsanitary conditions from developing therein, reducing the chances of a transfer of foot disease between different users. This can occur if the device is used in a commercial setting, such as a commercial gym or health club. Because the device is intended to be used barefoot, the walking path belt and sand are susceptible to picking up bacteria or fungi from a user's feet. If moisture enters into the sand storage area, the bacteria and fungus can grow therein, and be picked up by a user. Therefore, careful treatment and frequent changing of the sand is necessary to prevent such unsanitary conditions.

Overall, the present invention provides a new and novel treadmill walking device that allows a user to walk barefoot or without specialized shoes to absorb the impact from the otherwise hard treadmill belt surface. A layer of sand is conveyed along the belt during operation and collected into a base below the belt. The sand is therefore recycled, and the user is provided with a soft walking surface for exercising and enjoyment purposes. The device simulates walking in a sand environment while using a treadmill either at home or at the gym. The present invention permits a user to walk an indefinite number of miles without pounding their legs, joints, and bottoms of their feet on a hard, rubber surface. People who like walking barefooted on the beach and feeling the massage of the sand can appreciate the benefits afforded by this product.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sand treadmill walking device, comprising:

a base supporting a walking path conveyor belt having a leading end and a trailing end;

a sand storage area within said base comprising at least one sterilizing light fixture, said at least one sterilizing light fixture comprising at least one ultraviolet light source;

a sand conveyance means comprising at least one belt for flowing a continuous volume of sand from said sand storage area within said base to said walking path conveyor belt leading end;

at least one electric motor driving said belts and receiving electrical power;

an upstanding handrail for user support and having said walking path conveyor belt speed control.

2. The device of claim 1, wherein said base further comprises side portions and a conduit thereunder to allow sand to travel from said walking path conveyor belt lateral sides into said sand storage area.

3. The device of claim 2, wherein said conduit further comprises a coarse screen to allow said sand to pass therethrough but prevent large debris and objects from entering said sand storage area.

4. The device of claim 1, wherein said sand is deposited into said sand storage area along said walking path conveyor belt trailing end.

5. The device of claim 4, wherein said walking path conveyor belt trailing end further comprises a coarse screen to allow said sand to pass therethrough but prevent large debris and objects from entering said sand storage area.

6. The device of claim 1, further comprising a control system for controlling said sand conveyance means based on said walking path conveyor belt speed, whereby said sand conveyance means speed is adjusted relative to said walking path conveyor belt speed to ensure a sufficient volume of sand is being communicated onto said walking path conveyor belt leading end.

7. The device of claim 6, wherein said control system further comprises feedback sensors that monitor sand flow along said walking path conveyor belt and along said sand conveyance means.

8. The device of claim 1, further comprising a leveling bridge for leveling said sand to a defined depth along said walking path conveyor belt leading end.

9. The device of claim 1, wherein said sand conveyance means belt further comprises an elongated belt having a plurality of pulleys and sand paddles to flow sand from said walking path conveyor belt trailing end to said leading end.

10. The device of claim 1, wherein said sand storage area is an enclosed volume having sidewalls that prevent loss of sand therefrom and provide penetrations for said sand conveyance means belt.

11. The device of claim 1, wherein said sterilizing light fixture further comprises a heat lamp to remove moisture from said sand storage area.

12. The device of claim 1, wherein said base further comprises steps for accessing said walking surface.

13. The device of claim 1, wherein said walking path conveyor belt further comprises a support member between opposite traveling belt surfaces to support a user's weight and prevent collapse of said walking path conveyor belt.

* * * * *